US007623938B2

(12) United States Patent
Luhnow et al.

(10) Patent No.: US 7,623,938 B2
(45) Date of Patent: Nov. 24, 2009

(54) LOOK-UP TABLE METHOD FOR CUSTOM FITTING OF APPAREL

(75) Inventors: Jeffrey Luhnow, St. Louis, MO (US); Robert Holloway, Novato, CA (US); Daniel Plummer, Emeryville, CA (US); Matthew Curcio, San Francisco, CA (US)

(73) Assignee: Archtype Solutions, Inc., Emeryville, CA (US)

( * ) Notice: Subject to any disclaimer, the term of this patent is extended or adjusted under 35 U.S.C. 154(b) by 481 days.

(21) Appl. No.: 11/337,349

(22) Filed: Jan. 23, 2006

(65) Prior Publication Data

US 2006/0195219 A1 Aug. 31, 2006

Related U.S. Application Data

(63) Continuation of application No. 10/796,337, filed on Mar. 8, 2004, now Pat. No. 7,020,538.

(60) Provisional application No. 60/453,034, filed on Mar. 6, 2003.

(51) Int. Cl.
*G06F 19/00* (2006.01)

(52) U.S. Cl. ..... 700/132; 700/130; 700/131

(58) Field of Classification Search ..... 700/130, 700/131, 132; 30/2 R; 705/26, 27; 33/2 R
See application file for complete search history.

(56) References Cited

U.S. PATENT DOCUMENTS 4,846,577 A 7/1989 Grindon (Continued)

FOREIGN PATENT DOCUMENTS

WO WO2004079555 (A3) 3/2004

OTHER PUBLICATIONS

PCT International Preliminary Report on Patentability for PCT/USO4/07100, Feb. 22, 2008 (Attached).

*Primary Examiner*—Gary L Welch
*Assistant Examiner*—Nathan E Durham
(74) *Attorney, Agent, or Firm*—Milbank, Tweed, Hadley & McCloy LLP

(57) ABSTRACT

We disclose and claim a method for custom fitting an article to a human being or animal comprising, selecting on the basis of body information about said human being or animal a subset of entries from a database populated with entries, wherein said entries comprise data from which said article is designed. We also disclose and claim a method for custom fitting an article to a human being or animal comprising, obtaining body information about said human being or animal, populating a database with entries comprising data about other individual human beings or animals selected from the group consisting of body dimensions and body information, selecting a subset of entries from said database on the basis of said body information about said human being or animal, and designing said article on the basis of said subset of entries. We also disclose and claim a system for custom fitting an article to a human being or animal comprising, a means for obtaining body information about said human being or animal, a means for populating a database with entries comprising data about other individual human beings or animals selected from the group consisting of body dimensions and body information, a means for selecting a subset of entries from said database on the basis of said body information about said human being or animal, and a means for designing said article on the basis of said subset of entries. We also disclose and claim a custom fitted article for a human being or animal, wherein said article is designed on the basis of a subset of entries from a database, wherein said database is populated with entries comprising data about other individual human beings or animals selected from the group consisting of body dimensions and body information, and wherein said subset is selected on the basis of body information about said human being or animal.

6 Claims, 1 Drawing Sheet

U.S. PATENT DOCUMENTS 5,515,268 A 5/1996 Yoda
5,757,661 A 5/1998 Surville
5,768,135 A 6/1998 Park et al.
5,930,769 A * 7/1999 Rose ..... 705/26
6,353,770 B1 3/2002 Ramsey et al.
6,507,309 B2 1/2003 McMakin et al.
6,546,309 B1 4/2003 Gazzuolo
6,564,118 B1 5/2003 Swab
6,665,577 B2 12/2003 Onyshkevych et al.
7,346,421 B2 * 3/2008 Bijvoet ..... 700/132
2001/0026272 A1 * 10/2001 Feld et al. ..... 345/419
2002/0138170 A1 * 9/2002 Onyshkevych et al. ..... 700/130
2002/0188372 A1 * 12/2002 Lane et al. ..... 700/130
2004/0083142 A1 * 4/2004 Kozzinn ..... 705/27

* cited by examiner

LOOK-UP TABLE METHOD FOR CUSTOM FITTING OF APPAREL

This application is a continuation of U.S. patent application Ser. No. 10/796,337, filed Mar. 8, 2004, U.S. Pat. No. 7,020,538, which claims priority from provisional application U.S. Ser. No. 60/453,034 filed Mar. 6, 2003.

FIELD OF THE INVENTION

This invention relates to custom manufacturing of apparel and more particularly to a method of creating a custom fitted garment on the basis of less-than-complete information about a customer's body dimensions. More specifically, this invention relates to the use of a look-up table—which contains body dimension or garment dimension or other qualitative data or various combinations of this information collected from individuals (who may be a representative sample of the adult population as a whole) in the past—to generate a custom fitted garment for a new customer on the basis of incomplete information about the new customer's body dimensions as well as additional information provided by the new customer, such as, for example, answers to qualitative questions, information regarding style or fit preferences or both and self-identification with a graphical representation of one or more body shapes. Even more specifically, this invention relates to the selection of one or more individuals in the look-up table by finding a best match between the customer-supplied body dimensions and/or information and the corresponding body dimensions for, and/or qualitative data provided by, the individuals already in the look-up table, and then using additional body and/or garment dimensions of the selected individual to create a garment for the new customer.

BACKGROUND OF THE INVENTION

One of the biggest problems that apparel retailers face is matching apparel consumers with garments that have all the desired properties, features for a perfect fit. The vast majority of apparel retailers struggle with managing the tradeoff between offering a larger assortment of products and paying the high costs of carrying large amounts of inventory. A company that offers a large assortment of products, product features or variations, and sizes quickly finds the costs of inventory, inventory handling costs, and infrastructure (e.g., distribution centers) become prohibitively large as the number of stock keeping units (SKUs) increases. Conversely, a company with a more limited assortment will find that consumers either can't find the product or size they desire or choose a product that often they are not satisfied with and end up returning the garment. The combined cost associated with inventory and merchandise returns represents a significant portion of the overall costs for apparel retailers, particularly those who sell through direct channels such as the Internet, TV, or mail. The lost revenue opportunity for apparel retailers of all types, including store based retailers, associated with not having the correct size or product in stock can easily make the difference between a struggling and successful company. Those consumers who find an apparel product in their size are often times settling for the best available option rather than selecting a garment that fits them properly. A survey cited in U.S. Pat. No. 5,548,519, issued to Sung K. Park on Aug. 20, 1996, for an apparatus and method for custom apparel manufacturing, found that the percentage of the population that is correctly fitted by an available standard-sized article of clothing without any alteration is only two percent.

Apparel companies use two fundamentally different approaches to find garments that best meet their needs. The first approach captures information about a consumer and uses that information to recommend particular brands, products, and sizes that are likely to fit or match a consumer's tastes. The benefit of this approach is that it theoretically increases the probability that a consumer will find the best available standard product. The two drawbacks are that this approach doesn't solve the assortment-inventory tradeoff described previously nor does it resolve the issue of failure to achieve proper fit without further garment alteration.

The second approach creates custom apparel garments for consumers after preference and sizing information has been captured. The apparatus and method disclosed in U.S. Pat. No. 5,548,519 is an example of this approach. This approach has consumers try on any number of products of predetermined dimensions until the consumer approves the fit and purchases the garment. The company reports the information captured during the try-on session to a manufacturing system that initiates garment creation. Another approach, described in U.S. Pat. No. 5,956,525, issued to Jacob Minsky on Sep. 21, 1999, for a method of measuring body measurements for custom apparel manufacturing, uses multiple cameras in a specially designed room, capturing height and body width data about the consumer. The company then uses these data to manufacture the clothing.

These approaches provide the manufacturing system with information that is useful in producing a custom garment and will likely result in a better fitting garment than the standard sizes. Since the garments are manufactured after the consumer order has been completed there is a reduced need for retailers to carry large amounts of finished-goods inventory. The drawback of these approaches is that each requires substantial involvement and time from the consumer. The majority of consumers perceive shopping for apparel not as a particularly desirable activity but rather a necessary evil. Any product that requires more involvement and more time from consumers will find limited potential in today's environment where an increasingly large number of household or personal needs can be met from a computer, a laptop, a PDA or a cell phone.

Applicants hereby incorporate by reference U.S. patent application Ser. No. 09/909,930, and any patent that issues therefrom. Applicants also incorporate by reference U.S. Pat. No. 6,516,240, issued Feb. 4, 2003 and U.S. Pat. No. 6,353,770, issued Mar. 5, 2002.

OBJECTS OF THE INVENTION

It is an object of the present invention to provide a system and method for capturing information about a person and using that information to produce exact specifications for an apparel product and instructions to create a custom apparel product. The person can communicate this information remotely over the phone, using the Internet, interactive television, via mail or through any other communication device that is used for wireless communication or electronic commerce such as web-enabled phones or personal digital assistants (PDAs). Users can communicate this information directly to a retailer's agent, a kiosk, or any other information capture tool in a store environment.

A consumer is asked a series of questions about themselves and their body dimensions (or the person for whom they are purchasing the item), their garment preferences, desired features and other product choices about the prospective garment purchase. It is an object of the invention to enable the construction of a well-fitting custom-designed garment on the basis of less-than-complete information from the consumer regarding their body dimensions.

It is an object of the present invention to implement a best-matching procedure to select an individual (or subset of individuals) entry from a look-up table database that contains more complete body dimension and/or garment dimension data and/or qualitative information on the basis of the less-than-complete data and qualitative information provided by the consumer. It is an object of the present invention to use the more complete body dimension and/or garment dimension data and/or qualitative information of the selected look-up table entry (or entries) to manufacture a garment for the consumer that is better fitting than it would have been if only the less-than-complete data and information provided by the consumer were used.

It is an object of the present invention to provide a method of shopping for products that can be customized based on an individual person's body shape, lifestyle attributes, and product preferences which allows customers to quickly, easily and conveniently order custom apparel.

Another object of the present invention is to provide a system and method of determining necessary product specifications such as garment dimensions based upon both consumer-provided and look-up-table-derived human body measurements and garment dimensions and qualitative information that provides retailers and manufacturers of these products with all the necessary dimensions and other specifications required to produce a custom apparel product. Yet another object of the present invention is to provide a method for adjusting calculated garment dimensions on the basis of consumer-selected garment fit preferences and other qualitative information.

A further object of the present invention is to provide a method of shopping for products that can be customized based on an individual person's body shape and product preferences as a marketing and sales tool for retailers and manufacturers to provide custom apparel for consumers.

These and other features of the present invention are described in more detail in the following detailed description. The scope of the invention, however, is limited only by the claims appended hereto.

SUMMARY OF THE INVENTION

The present invention includes a method for custom fitting an article to a human being or animal comprising, selecting on the basis of body information about said human being or animal a subset of entries from a database populated with entries, wherein said entries comprise data from which said article is designed. The present invention also includes a method for custom fitting an article to a human being or animal comprising, obtaining body information about said human being or animal, populating a database with entries comprising data about other individual human beings or animals selected from the group consisting of body dimensions and body information, selecting a subset of entries from said database on the basis of said body information about said human being or animal, and designing said article on the basis of said subset of entries. The present invention also includes a system for custom fitting an article to a human being or animal comprising, a means for obtaining body information about said human being or animal, a means for populating a database with entries comprising data about other individual human beings or animals selected from the group consisting of body dimensions and body information, a means for selecting a subset of entries from said database on the basis of said body information about said human being or animal, and a means for designing said article on the basis of said subset of entries. The present invention also includes a custom fitted article for a human being or animal, wherein said article is designed on the basis of a subset of entries from a database, wherein said database is populated with entries comprising data about other individual human beings or animals selected from the group consisting of body dimensions and body information, and wherein said subset is selected on the basis of body information about said human being or animal.

DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION OF THE PREFERRED AND OTHER EMBODIMENTS

Figure 1:
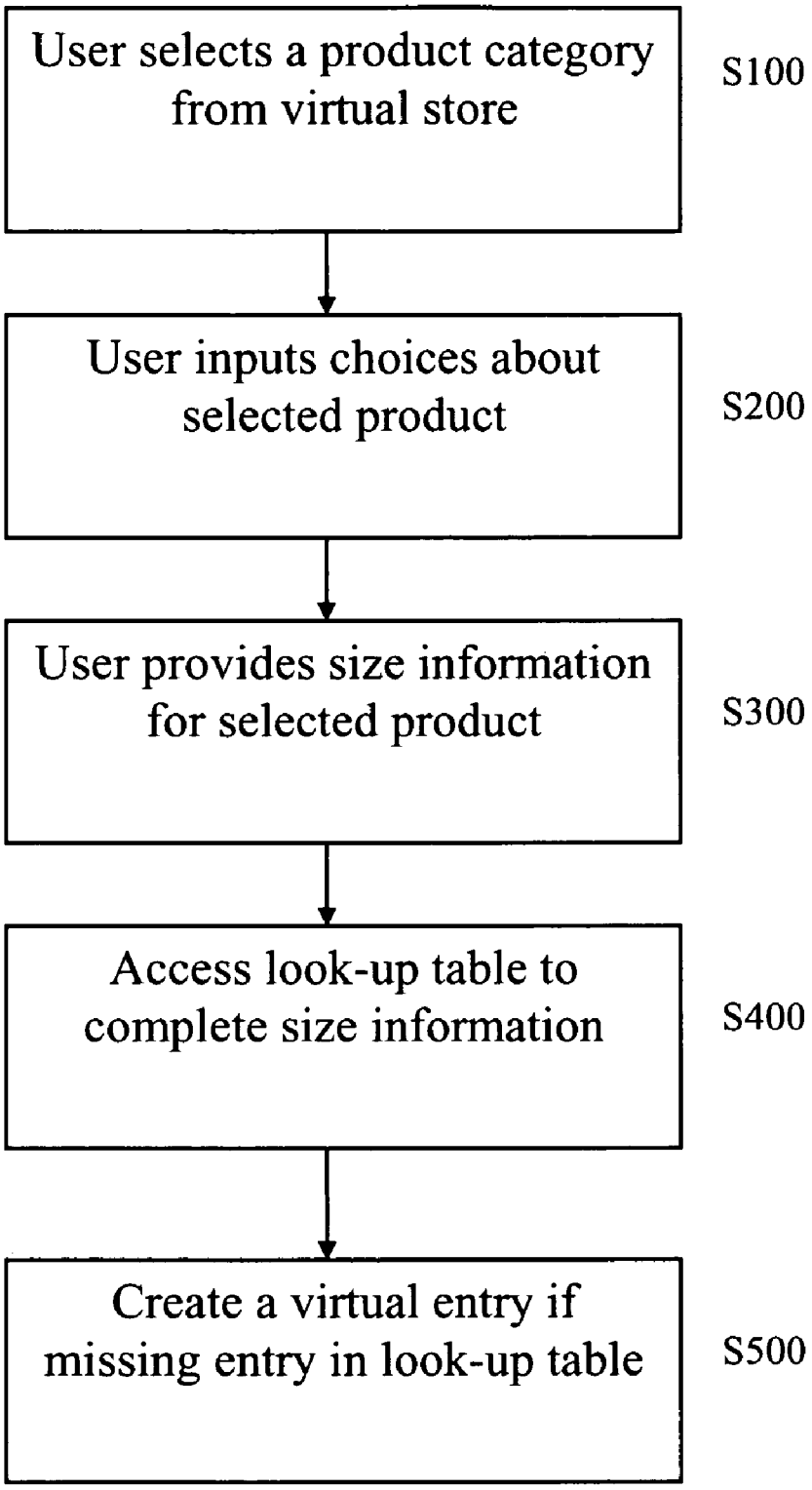
FIG. 1 shows a flowchart of a look-up table method for custom fitting of apparel according to an embodiment of the present disclosure.

There are numerous ways an apparel retailer can capture necessary information from a consumer interested in purchasing apparel, both remotely and in-store. Remotely, the interested consumer can access a retailer's web site through a computer, a PDA, a web enabled phone, interactive television, or any other electronic medium used to access the Internet. Also remotely, the interested consumer can call a retailer's customer service or ordering center, or they could send a fax or use any form of mail. In a retail store environment, the interested consumer could either provide the information directly to an employee of the retailer, or use any self-service device in the store such as a written order form, kiosk, Internet terminal or customer service telephone.

In a preferred embodiment, the potential consumer would log on to the retailer's web site. This web site may have a combination of standard and custom products or may offer exclusively custom made products. As shown in Step S100 of FIG. 1, the potential consumer would choose the portion of the virtual store that offers custom made products and then select the product category in which they are interested (including, but not limited to, a pair of pants, a pair of jeans, a sweater, a skirt, a dress, a shirt, a blouse, a vest, a jacket, a coat, a pair of knickers, a pair of leggings, a jersey, a pair of shorts, a leotard, a pair of underwear, a hat, a cap, and a swimming or bathing suit). As shown in Step S200, once the prospective consumer has selected the product category then he or she begins to make choices about the desired product. In the case of pants, the consumer chooses the fabric, the color, the style, the preference for cuffs, pleats, and the type of fly (zipper or button). These comprise a non-comprehensive list of some of the feature and style choices that could be available.

As shown in Step S300, once the potential consumer has made all of the feature and style choices for the product, he or she provides the information needed for sizing. The information that is collected for sizing may be the less-than-complete information that most apparel consumers know about himself or herself or the person for whom they are ordering the product, and that can be used to either (1) directly determine desired measurements for the design of the garment pattern, or (2) obtain a best match to an entry in a look-up table that will then provide additional, more-complete, information about body and/or garment dimensions that can be used to generate the garment pattern. The consumers may also be asked to make assessments of himself/herself and the body shape or others, as well as to take simple measurements of certain of their body dimensions, or the dimensions of the person for whom the garment will be ordered.

As shown in Step S400, once the less-than-complete information is collected from the potential consumer, that information may be used in conjunction with a look-up table containing entries, each of which contains more complete body and/or garment dimension data and/or qualitative information for a particular individual person who has either been previously measured and/or provided a garment, to determine the exact garment dimensions for that consumer. This look-up table may be pre-populated with entries derived from detailed body dimension measurements taken from a large number of people of varying body types and shapes using a variety of measurement techniques well-known in the prior art, including laser or white-light or radar scanning methods. In addition, entries to the look-up table may be added as additional customers provide feedback concerning the quality of fit of garments designed using the look-up table-based method. These entries contain the less-than-complete information provided by the consumer, as well as the actual garment dimensions of the garment provided to the consumer.

When the look-up table is initially populated with entries derived from the actual detailed measurements of numerous people it may still be that the table is too sparsely populated to find a match near enough to the less-than-complete information provided by the consumer to enable the construction of a reasonably-well-fitting garment using just the additional body and garment dimensions residing in a single entry of the table. As shown in Step S500, one possible solution method is—in the event that a near-enough match is not found (where closeness of match may be measured as a weighted sum of squared differences between each of the less-than-complete set of body dimensions provided by the consumer and the corresponding dimensions in a table entry)—to create a "virtual" entry in the table through weighted interpolation between more than one relatively-nearby entry.

There may also be instances in which there are numerous entries in the look-up table that match the less than complete information provided by the consumer. In such a case, additional filtering, matching or other mathematical techniques based on, for example, qualitative information and/or mathematical techniques may be implemented to select, and/or average, one or more of such entries.

EXAMPLE 1

An example of a look-up table and the way in which it can be used to generate a custom garment on the basis of less-than-complete information from the consumer is provided here. This example is not meant to be limiting to full the scope of the invention, as many other specific implementations are consistent with the invention.

Structure of the Look-Up Table and Initial Pre-Population Along the Body Dimensions—

Each entry in the look-up table can be considered a point in a multi-dimensional space, where the dimensions can be selected from all of the various human body dimensions and garment dimensions relevant to the construction of a garment. The value for a given individual human being along each of these dimensions in the multi-dimensional space is represented by a point in the space. The table is pre-populated with n points, each point representing the complete body dimensions of a specific (although anonymous) person who has been measured using a white-light scanning method. In this initial pre-population, the entries will not have any values along the garment dimensions of the multi-dimensional space.

Finding the Best-Match Entry in the Look-Up Table to the Less-Than-Complete Body Dimensions Provided by a Customer When a customer orders a custom garment, the customer supplies only a subset of the complete set of body dimensions represented in the look-up table. The task is then to identify which entry (or subset of entries) in the look-up table (i.e., the populated point in the multi-dimensional space) that has values for the customer-supplied subset of body dimensions that is closest to those supplied by the customer. This closest-matching procedure can be implemented by any of a number of mathematical techniques well known in the prior art, including finding the table entry with the smallest sum over the relevant subset of dimensions of the squared differences between the customer-supplied values and the values in the table entry. A more flexible measure of closeness would allow for the differential weighting in the sum of the various dimensions. For example, if it is determined through experience that waist correlates more closely with the other dimensions than inseam, then the squared difference in waist would have a larger weighting coefficient than the squared difference in inseam.

If the customer-supplied values are not within some predetermined minimum distance from any single populated point in the multi-dimensional space, then a "virtual" point is created using standard interpolation between some subset of nearby points.

Using the Best Match Entry to Construct a Garment

Once the best match actual entry (or virtual entry) is identified, then the more-complete set of body dimension values of the table entry are used to supplement those supplied by the customer to design a garment pattern using techniques well-known in the pattern-making arts.

Populating the Look-Up Table Database Along the Garment Dimensions

Once a customer has purchased a garment, a new entry in the look-up table is created that contains as values along the garment dimensions, the dimensions of the garment constructed as described above, and as values along the body dimensions, both customer-supplied values and the supplemented values obtained as described above. Until feedback is received from the customer concerning the fit of the garment, the new table entry is flagged as having a low "reliability" index. If the customer feedback is ultimately positive about the fit of the garment, then the reliability index is increased.

Using Newly-Populated Table Entries Containing Values Along the Garment Dimensions to Construct a Garment for a New Customer If the closest match table entry to a customer-supplied set of body dimension values is an entry that contains garment dimension values, then those garment dimension values are used directly to construct the pattern for the new customer rather than using the additional body dimension values in the entry.

EXAMPLE 2

Difficult to determine measures, for a body or garment, are aggregated into a database along with the corresponding easy to determine measures. A data point in this dataset may be created by a person filling out a questionnaire of self assessment questions (e.g. seat shape, self measured waist) and subsequently being scanned in a body scanner. This data may be compiled together to create an entry in the lookup dataset. When a customer wishes to purchase a garment, he or she may be asked to fill out a similar self assessment questionnaire to the one mentioned above. To determine specific measures for this customer's body or garment a "best match" may be found in the lookup dataset. This "best match" and the associated hard-to-determine measures may be used as surrogates for the new customer's measures. These measures may then be used to create a garment. A simplified example would be "suppose we scanned your twin, you should, therefore, answer the input survey in a similar fashion subsequently this twin would be your "best match" in the dataset via the lookup process and his specific measures would be used to determine your garment measures".

A general purpose data mining algorithm that compares and matches a pre-defined set of variables (body measurements, qualitative values from a questionnaire), the input set, against a comprehensive set of information may be used. Each tuple in this database of information includes the responses to a survey of questions (which contains the input set) as well as an extensive set of measures derived from point clouds (as are well-known in the body-scanning arts) of optical full-body scans (these measures could be obtained from other techniques as mentioned previously). The derived measures are surrogates for highly accurate measures for specific, canonical, uniformly recognized-dimensions of the human body (e.g. waist girth, shoulder height). The current database provides a relatively representative sample of the adult population of the United States of America.

Creation of the Lookup Data.

The data set is comprised of the answers to a self assessment questionnaire and the outputs of the scan process. There is currently a one-to-one mapping between scans and entries in the dataset. Alternatively, this data set could be created from canonical data points. In this scenario a secondary data set is created from the original one-to-one set described above, based on experts determining the canonical data points. For instance, a canonical data point could be labeled "petite, 105 lb, pear shaped, size 2 female". This data point could be a statistical average of all the individual scans that fall within this classification. This method significantly reduces the size of the data set. The data set could also be extended using classifications created by apparel experts, a mathematical process to determine which minimal subset of variables cover the space adequately (finding the eigenvectors of the space or similar) or some other technique.

The lookup dataset could also contain garment measures for each data point as well as body measures. In this way the dataset can grow in size and accuracy through existing customers rating the performance of their garments. A measure of accuracy can be assigned to each data point depending on the customer assessment rating of the key measures of the garment.

Look Up Process

When a new customer places an order they complete the self-assessment questionnaire. The answers to these questions are used to find a "best match" in the lookup data set. The algorithm has been designed to produce a "best match" for any given set of inputs and search parameters. The algorithm first generates specialized queries to the database of derived measures. Queries search against values in the tuple reported from the survey. The algorithm performs either an exact match (e.g. hip shape="curvy") or a neighborhood match (e.g. weight between 100 and 105 lbs inclusive) for each individual variable. The use of a wildcard is allowed on variables which do not require a specific value. The algorithm can also be adapted to perform on databases with different optimization parameters. Currently the algorithm performs searches against the raw database seeking a match set for a given query. The algorithm can also be adapted to perform searches on a database that has been transformed. Possible transformations include analyses and mathematical filtering that reduces the raw set into a "minimal" set as well as filtering data. This can be conceptualized as the set as containing all the archetypical bodies in the United States. There would be no overlap between bodies (unless mathematically designed to intersect at some level like Venn diagrams) but there may be missing values if the unfiltered data set is not truly representative of the population as a whole. If the search produces a single match this suggests that a person has been identified in the database who is a reasonable surrogate for the customer. Values from the scanned portion of the tuple (e.g. waist girth, inner leg length, hip girth, or other hard to predict measures) are then used to design an article of clothing (e.g. woman's jeans).

Occasionally the algorithm may return no results (no matches). This would suggest that the search was too specific (too many specific narrow values on search criteria) or that portions of the underlying database may be underpopulated. The algorithm may be designed with a feature that allows intelligent searches. These are performed by eliminating one search variable, expanding the range of possible values on a search variable or both. This can be applied iteratively until a nonzero result set is obtained.

If the search produces multiple results, there are two options. The first option is to recursively apply the opposite strategy of the no matches scenario. Rather than reducing the search set it can either be increased by adding more variables (e.g. changing wildcards to specific values) or narrowing the scope of variables (e.g. changing weight between 100 and 105 lbs inclusive to weight between 100 and 102 lbs inclusive) until a unique match is arrived at or the search set is reduced. The second option is to apply statistical measures to the search set and to simply average the final values.

When the algorithm returns nonzero search sets strategies may be implemented to automatically determine the quality of the set and to filter (and report) anomalies. The algorithm must determine the heterogeneity of the set. If homogeneous then the set is acceptable and those values (or some statistical filter such as means or medians) to predict garment dimensions. If the return set is not homogeneous there are currently two conditions for which filtering is performed.

The algorithm first applies an outlier analysis. If the heterogeneity is due to a small number of outliers on a dimension those outliers are eliminated. If there are two or more distinct distributions (i.e. the return distribution for waist girth is multimodal) this suggests that the search performed was not deep enough and that stratification on one variable is still possible. The algorithm attempts to segregate the two sets by deeper searches.

Occasionally the match from a search does not match with the customer's actual dimensions. There also are sets which cannot be further segregated. Some of this is because the reporting mechanism (when people complete the survey) is inherently fuzzy. For instance "curvy hips" comprises a fuzzy set of people, some of whom may be archetypes for curvy hips while other may be on the cusp of "average hips". Some elements of fuzzy logic theory may be incorporated in choosing and categorizing these variables and probabilistic values may be assigned (based initially of Bayesian laws) to provide the user with a "goodness" rating on the return set.

We claim:

1. A method for custom fitting a clothing article for a being, comprising:

a) receiving body dimensions of said being;

b) accessing a database populated with information about other beings, the information for each of the other beings including at least one of body dimensions and clothing article dimensions;

c) selecting a model being from the other beings based on the body dimensions of said being and body dimensions of the other beings, when no other being has body dimensions within a first predetermined proximity to said being, identifying a subset of other beings having body dimensions within an expanded, second predetermined proximity to the body dimensions of said being; and d) designing said clothing article based on at least one of the body dimensions of the model being and the clothing article dimensions of the model being.

2. The method of claim 1, further comprising:

e) creating information for a new other being, including at least one of body dimensions and clothing article dimensions interpolated from the subset of other beings.

3. The method of claim 2, further comprising:

f) storing in the database, information for the new other being, including at least two of the following: the body dimensions of said being, interpolated body dimensions that are not known for said being, and the interpolated clothing article dimensions.

4. The method of claim 3, further comprising:

g) assigning the information for the new other being a reliability index below a predetermined threshold.

5. The method of claim 4, further comprising:

h) increasing the reliability index of the information for the new other being above the predetermined threshold based on input about a fit of said clothing article.

6. A method for custom fitting a clothing article for a being, comprising:

a) receiving body dimensions of said being;

b) accessing a database populated with information about other beings, the information for each of the other beings including at least one of body dimensions and clothing article dimensions, wherein, for information on an other being stored in the database, the total number of clothing article dimensions are greater than the total number of body dimensions;

c) selecting a model being from the other beings based on the body dimensions of said being and body dimensions of the other beings; and d) designing said clothing article based on at least one of the body dimensions of the model being and the clothing article dimensions of the model being.

* * * * *